US009475179B2

(12) United States Patent
Lee

(10) Patent No.: US 9,475,179 B2
(45) Date of Patent: Oct. 25, 2016

(54) HAND TOOL WITH RATCHETING FEATURE

(71) Applicant: Chih-Ming Lee, Taichung (TW)

(72) Inventor: Chih-Ming Lee, Taichung (TW)

( * ) Notice: Subject to any disclaimer, the term of this patent is extended or adjusted under 35 U.S.C. 154(b) by 269 days.

(21) Appl. No.: 14/459,290

(22) Filed: Aug. 13, 2014

(65) Prior Publication Data

US 2016/0046005 A1 Feb. 18, 2016

(51) Int. Cl.
*B25B 15/06* (2006.01)
*B25B 23/00* (2006.01)
*B25B 15/02* (2006.01)

(52) U.S. Cl.
CPC ..... *B25B 15/06* (2013.01)

(58) Field of Classification Search
CPC .... B25B 15/06; B25B 15/02; B25B 23/0042
USPC ..... 81/58.1
See application file for complete search history.

(56) References Cited

U.S. PATENT DOCUMENTS 54,069 A * 4/1866 Hartford ..... B25B 15/06 74/127
143,084 A * 9/1873 Laudermilch ..... B25B 15/06 30/276
1,415,822 A * 5/1922 Fegley ..... B25B 15/06 74/127
2,521,816 A * 9/1950 Adams ..... B25B 15/06 408/120
7,946,198 B2 * 5/2011 Gui ..... B25B 15/04 74/127

* cited by examiner

*Primary Examiner* — Hadi Shakeri

(57) ABSTRACT

A hand tool includes a handle, a tubular member, a driving rod and a return unit. The handle has a passage, a pressing recess, a releasing recess, an engaging recess and a first hole. The tubular member extends through the passage. The driving rod is inserted through a through hole of the tubular member. A bead is located in a bead hole of the tubular member and the first hole. The return unit is used to return the driving rod. The handle is located at a press position or a release position relative to the tubular member.

13 Claims, 17 Drawing Sheets

HAND TOOL WITH RATCHETING FEATURE

BACKGROUND OF THE INVENTION

1. Fields of the Invention

The present invention relates to a hand tool, and more particularly, to a ratcheting hand tool to rotate an object.

2. Descriptions of Related Art

U.S. Pat. No. 7,946,198 discloses a ratcheting tool wherein the handle is linearly movable so as to drive the driving rod to rotate in a tubular member and to be linearly retracted in the tubular member, such that the object (such as bolt) connected with the function end of the driving rod can be rotated to be tightened or loosened. The disadvantage of the invention is that the driving rod is moved back to its initial portion and to be ready for the next use by using a spring, and the driving rod has to rotate 360 degrees relative to the handle. When the driving rod is retracted, the driving rod has to rotate 360 degrees relative to the handle as well, so that when the driving rod is retracted, the object connected with the function end of the driving rod is rotated. Nevertheless, when the driving rod moves back to its initial position, the object has to be separated from the function end, this means that the user has to separate the object from the function end, and re-connect the object to the function end repeatedly.

The present invention intends to provide a hand tool that eliminates the shortcomings mentioned above.

SUMMARY OF THE INVENTION

The present invention relates to a hand tool and comprises a handle, a driving rod and a return unit. The handle has a passage, a pressing recess, a releasing recess, an engaging recess and a first hole. A tubular member has a through hole, a bead hole, an annular groove, a first wall and a second wall. The driving rod has a spiral groove and straight slots which communicates with the spiral groove. The depth of the straight slots is smaller than that of the spiral groove. A bead is located in the bead hole and magnetically attracted by a magnetic member located in the first hole. The return unit has a push member, a spring and an end member. A C-clip is movably mounted to the engaging recess. The handle is located at a release position or a release position relative to the tubular member when the C-clip respectively contacts the first wall and the second wall.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
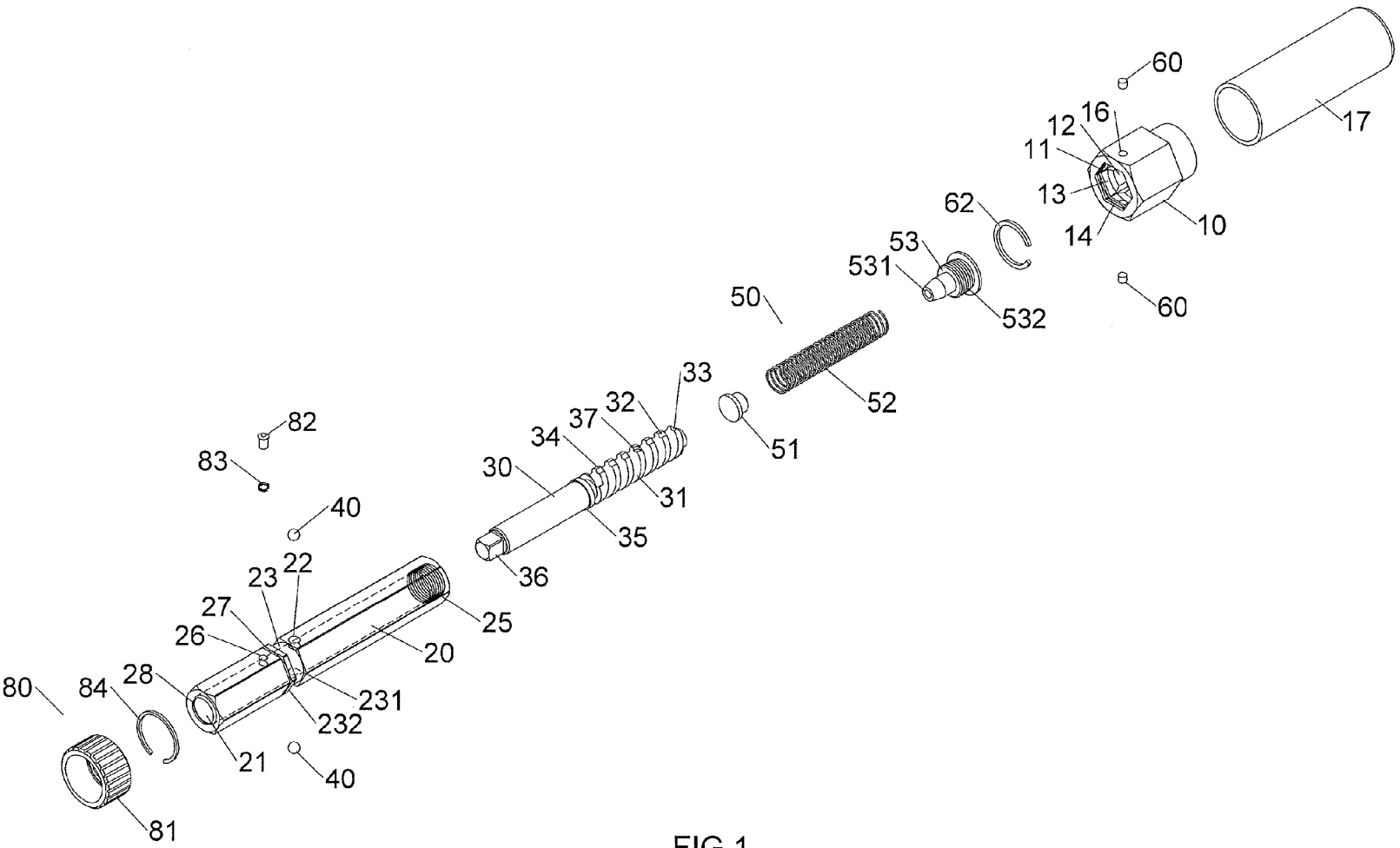
FIG. 1 is an exploded view of the hand tool of the present invention.
Figure 4:
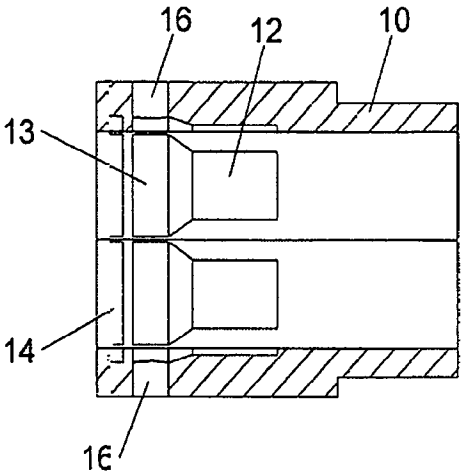
FIG. 4 is a cross sectional view, taken along line 4-4 in FIG. 3.
Figure 3:
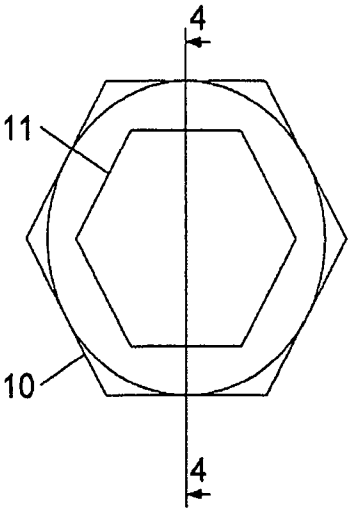
FIG. 3 is an end view of the handle of the hand tool of the present invention.
Figure 2:
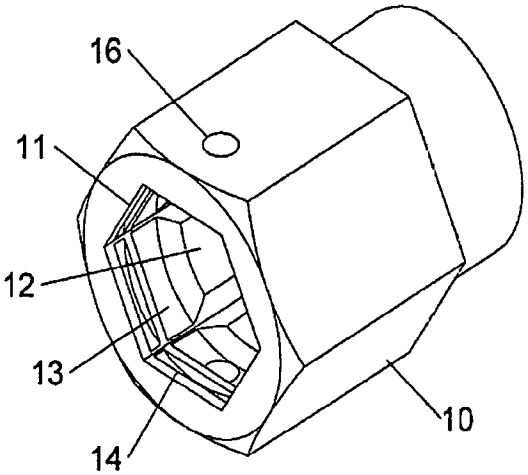
FIG. 2 is a perspective view to show the handle of the hand tool of the present invention.
Figure 6:
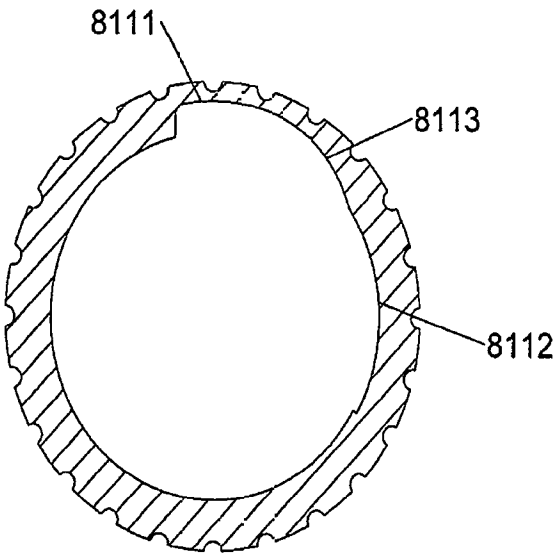
FIG. 6 is a cross sectional view, taken along line 6-6 in FIG. 5.
Figure 5:
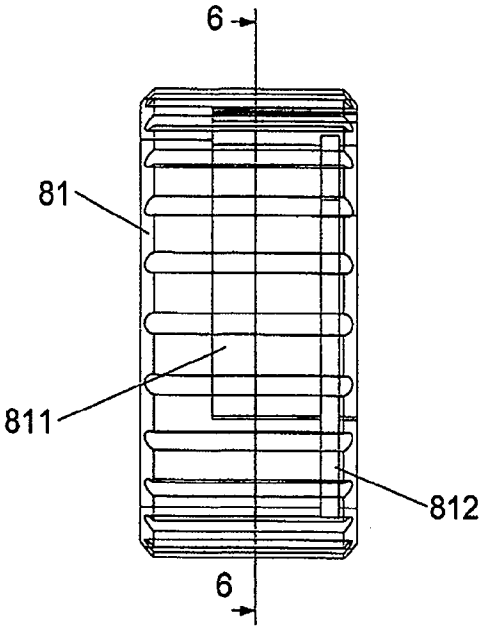
FIG. 5 is a side view of the control collar of the hand tool of the present invention.
Figure 7:
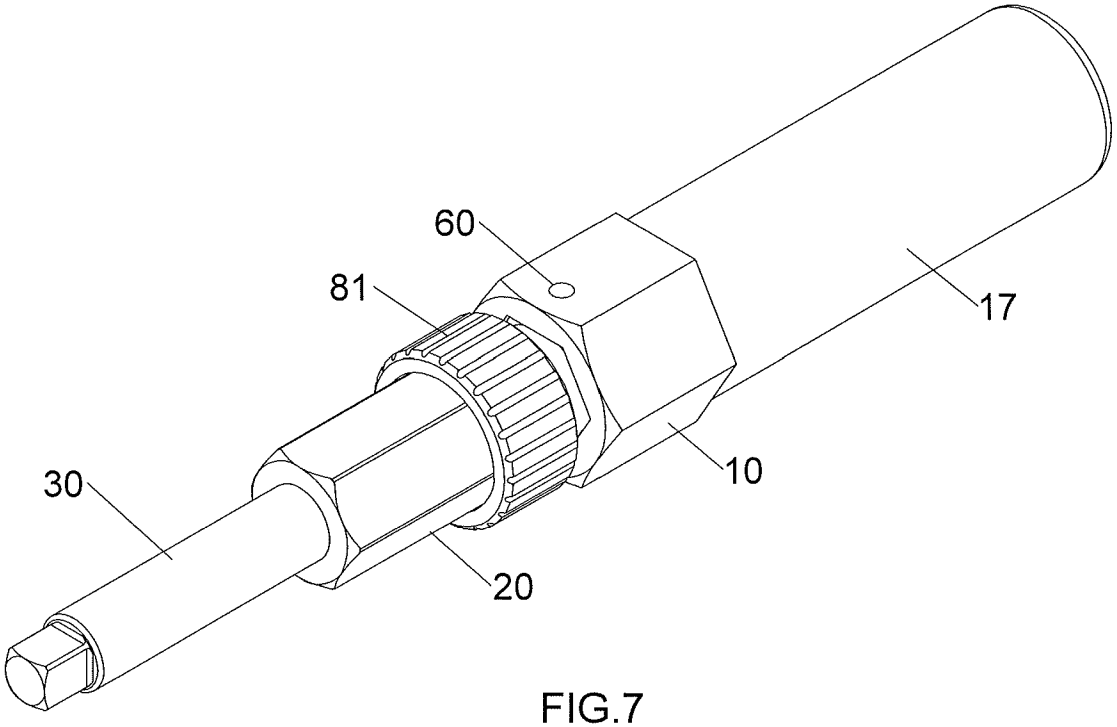
FIG. 7 is a perspective view to show the hand tool of the present invention.

Referring to FIGS. 1 to 7, the hand tool of the present invention comprises a handle 10, a tubular member 20, a driving rod 30, a return unit 50 and a control unit 80. The handle 10 has a polygonal (hexagonal) passage 11 defined therein, and a pressing recess 12, a releasing recess 13 and an annular engaging recess 14 are defined in the first end of the passage 11 in sequence. The annular engaging recess 14 located at the first end of the handle 10, and the releasing recess 13 located between the pressing recess 12 and the annular engaging recess 14. The inner diameter of the pressing recess 12 is larger than that of the passage 11, and the inner diameter of the releasing recess 13 is larger than that of the pressing recess 12. Two first holes 16 are defined through the wall of the handle 10 and communicate with the passage 11. The first holes 16 are located corresponding to the release recess 13. A holding portion 17 is connected to the second end of the handle 10 so that the user can hold the holding portion 17. A magnetic member 60 is engaged with each of the two first holes 16.

The tubular member 20 has a hexagonal cross section and is linearly and un-rotatably movable in the path 11. The tubular member 20 can be rotated by other hand tool such as a wrench. A through hole 21 is defined axially through the tubular member 20 and two bead holes 22 are defined through the wall of the tubular member 20. A bead 40 is engaged with each of the two bead holes 22 which are located corresponding to the two first holes 16. The beads 40 are magnetically attracted by the magnetic member 60. An annular groove 23 is defined in the outside of the tubular member 20 and located between a first wall 231 and a second wall 232. An inner threaded section 25 is formed in the inner periphery of the first end of the tubular member 20. A contact face 28 is formed at the second end of the tubular member 20. The tubular member 20 has a second hole 26 defined through the wall thereof. The tubular member 30 has a first snap groove 27 which is located close to the second hole 26 and between the annular groove 23 and the second hole 26. The first snap groove 27 is an annular groove.

Figure 9:
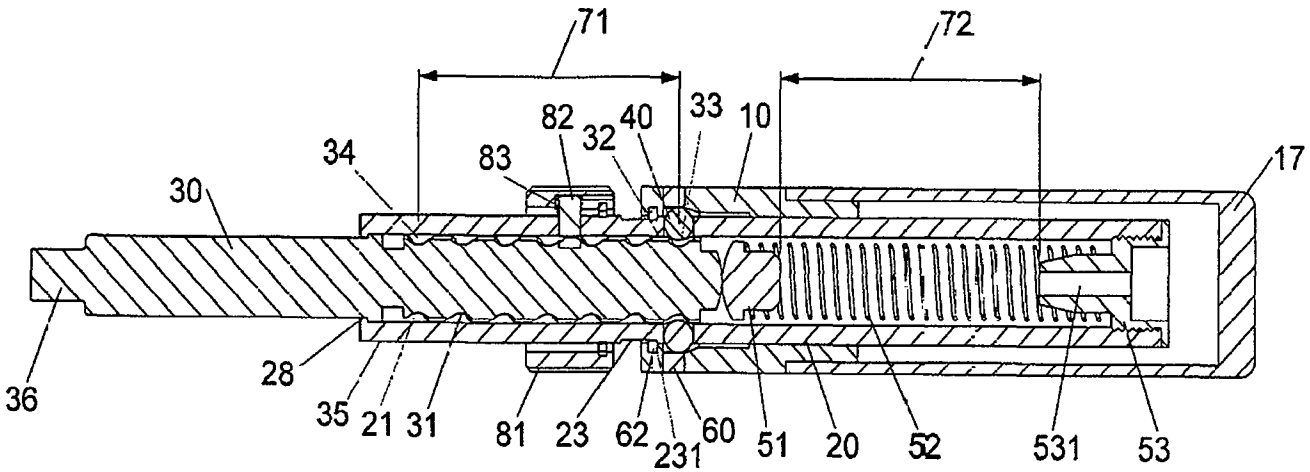
FIG. 9 is a cross sectional view, taken along line 9-9 in FIG. 8.

The driving rod 30 is linearly and rotatably movable in the through hole 21 of the tubular member 20. Multiple spiral grooves 31 and multiple straight slots 32 are defined in the outside of the first end of the driving rod 30. Preferably, there are two spiral grooves 31 and two straight slots 32. The depth of the straight slots 32 is smaller than that of the spiral grooves 31, and the spiral grooves 31 communicate with the straight slots 32. A start point 33 and an end point 34 are respectively formed on the first and the last ridges of the spiral grooves 31. A flange 35 extends outward from the mediate portion of the outside of the driving rod 30. The flange 35 contacts the contact face 28, and a function end 36 formed on the second end of the driving rod 30. The function end 36 is a rectangular end to which a socket or an extension rod is connected. The driving rod 30 has an engaging slot 37 defined in one of the straight slots 32, and the second hole 26 is located corresponding to the engaging slot 37. As shown in FIG. 9, a first distance 71 is defined between the start point 33 and the end point 34.

The return unit 50 is located in the through hole 21 of the tubular member 20 and has a push member 51, a spring 52 and an end member 53. The first end of the driving rod 30 contacts the push member 51. The spring 52 is biased between the push member 51 and the end member 53. The end member 53 has outer threads 532 on the outside thereof, and the outer threads 532 of the end member 53 are threadedly connected to the inner threaded section 25 of the tubular member 20. A second distance 72 is defined between two respective facing ends of the push member 51 and the end member 53. The first distance 71 is equal to the second distance 72.

A C-clip 62 is movably located within the engaging recess 14 and the annular groove 23. When the C-clip 62 contacts the first wall 231, the handle 10 is located at a release position relative to the tubular member 20. When the C-clip 62 contacts the second wall 232, the handle 10 is located at a press position relative to the tubular member 20.

The control unit 80 has a control collar 81 and an insertion member 82. The control collar 81 is rotatably mounted to the tubular member 20 and the insertion member 82 is inserted into the second hole 26. The first end of the insertion member 82 is located corresponding to the engaging slot 37. When the control collar 81 is rotated, the first end of the insertion member 82 is inserted into engaging slot 37, to secure the tubular member 20 with the driving rod 30 which cannot rotate and move in the tubular member 20. A resilient member 83 is mounted to the insertion member 82 and biased between the second end of the insertion member 82 and the outside of the tubular member 20. The control collar 81 has a control portion 811 formed in the inner periphery thereof. The control portion 811 has a first face 8111, a second face 8112 and a connection face 8113 which is connected between the first and second faces 8111, 8112. The curvature of the first face 8111 is different from that of the second face 8112. The diameter of the first face 8111 is larger than that of the second face 8112. The connection face 8113 is tangent to the first face 8111. The control collar 81 is a ring-shaped collar and has multiple slots defined in the outside thereof so that the user can easily rotate the control collar 80.

The insertion member 82 located in the second hole 26. The second end of the insertion member 82 contacts the control portion 811 and the first end of the insertion member 82 is located corresponding to the engaging slot 37. The control collar 81 has a second snap groove 812 which is located corresponding to the first snap groove 27. The control unit 80 has a clip 84 which is located in the first one snap groove 27 and the second snap groove 812. When the control collar 81 is rotated, the second end of the insertion member 82 contacts the first face 8111 and the resilient member 83 pushes the insertion member 82 to remove the first end of the insertion member 82 from the engaging slot 37. When the control collar 81 is continuously rotated, the second end of the insertion member 82 contacts the second face 8112 which pushes the insertion member 82, the resilient member 83 is compressed and the first end of the insertion member 82 is engaged with the engaging slot 37 so that the tubular member 20 is secured with the driving rod 30, the driving rod 30 cannot move and rotate in the tubular member 20.

Figure 8:
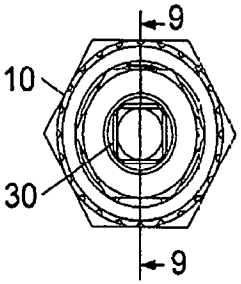
FIG. 8 is an end view of the hand tool of the present invention.

As shown in FIGS. 8 and 9, the first distance 71 is equal to the second distance 72. The C-clip 62 is movable between the first and second walls 231, 232. When the C-clip 62 contacts the first wall 231, the handle 10 is moved backward to be located at a release position relative to the tubular member 20. The first holes 16 are located corresponding to the bead holes 22, and the beads 40 are attracted by the magnetic members 60, so that the beads 40 are movable in the straight slots 32 of the driving rod 30.

Figure 10:
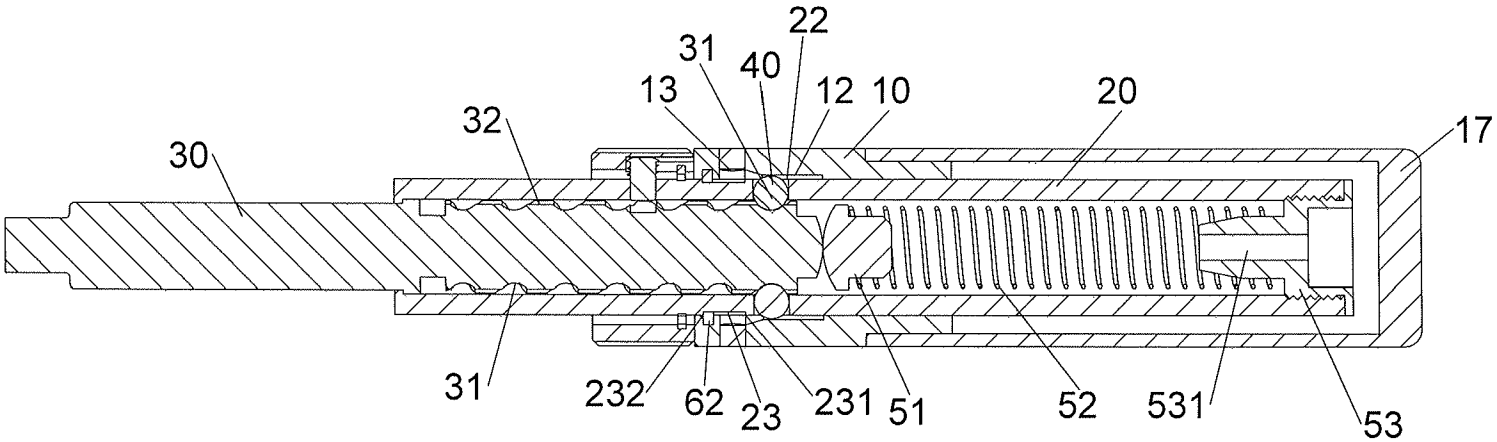
FIG. 10 shows that the handle is located at the press position.

As shown in FIG. 10, when the C-clip 62 contacts the second wall 232, the handle 10 is moved forward to be located at a press position relative to the tubular member 20. The beads 40 are movable in the spiral grooves 31 of the driving rod 30.

Figure 11:
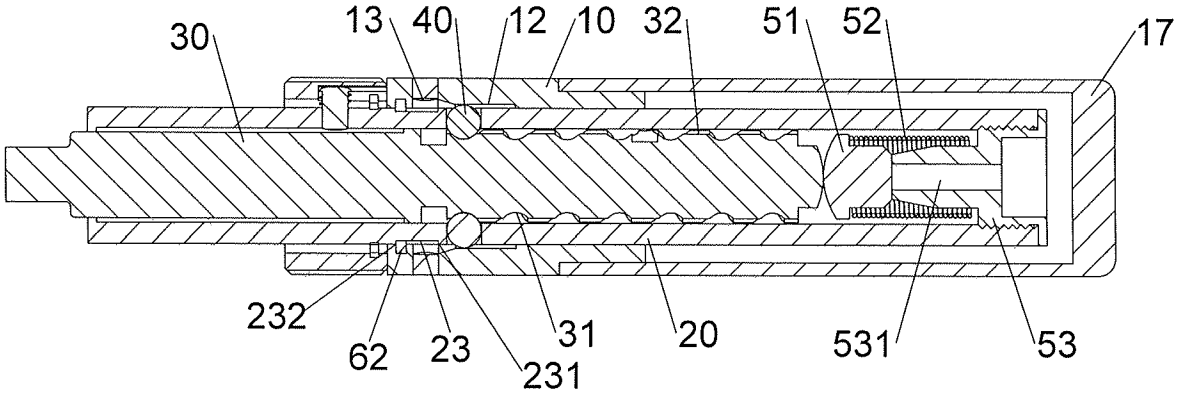
FIG. 11 shows the action of the driving rod of the hand tool of the present invention.

As shown in FIG. 11, when the handle is at the press position and continuously moved forward until the push member 51 contacts the end member 53, because the first distance 71 is equal to the second distance 72, the beads 40 move from the start point 33 toward the end point 34 along the spiral grooves 31. The driving rod 30 is rotated clockwise in the through hole 21 and is retracted into the tubular member 20. The push member 51 compresses the spring 52, and the air in the through hole 21 is escaped from the path 531, so that the movement of the driving rod 30 is smoothly and easily. The function end 36 of the driving rod 30 rotates the object.

Figure 12:
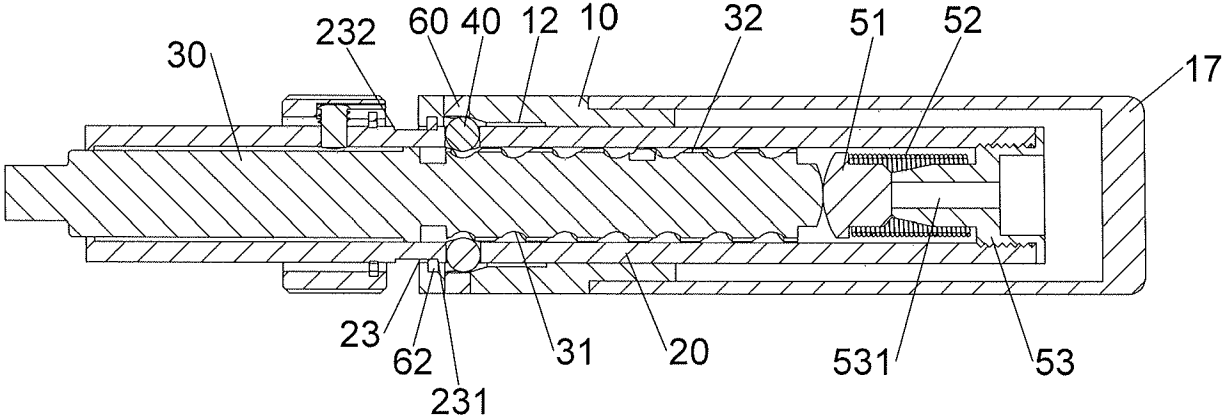
FIG. 12 shows that the handle is located at the release position.

As shown in FIG. 12, when the driving rod 30 is retracted to its travel end which means that the handle 10 is moved backward to the release position, the first holes 16 are located corresponding to the bead holes 22, the magnetic members 60 attract the beads 40, so that the beads 40 are movable within the straight slots 32.

Figure 13:
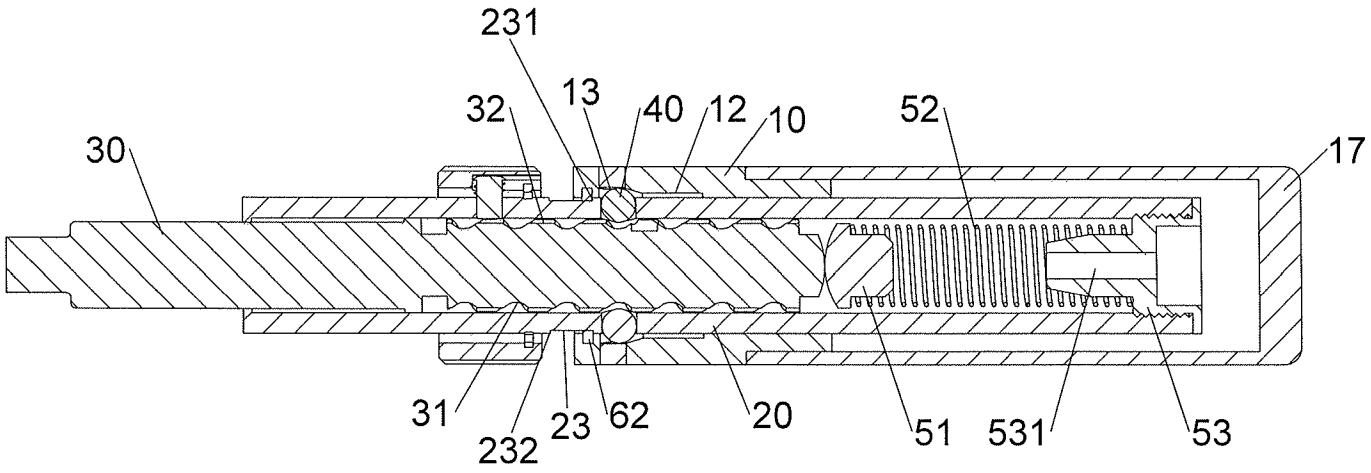
FIG. 13 shows the action of the return action of the driving rod of the hand tool of the present invention.

As shown in FIG. 13, when the handle 10 is at the release position, the driving rod 30 is pushed by the push member 51 due to the force from the spring 52, because the depth of the straight slots 32 is smaller than that of the spiral grooves 31, the beads 40 directly move back to the start point via the straight slots 32, so that the driving rod 30 is linearly moved back to the position as shown in FIG. 9. The driving rod 30 does not rotate when it moves linearly back to the position as shown in FIG. 9.

Figure 14:
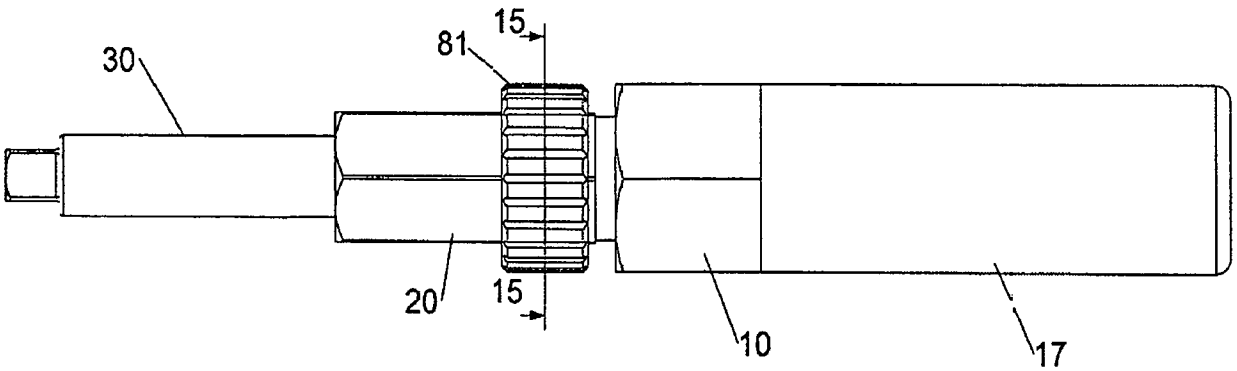
FIG. 14 is a side view of the hand tool of the present invention.
Figure 15:
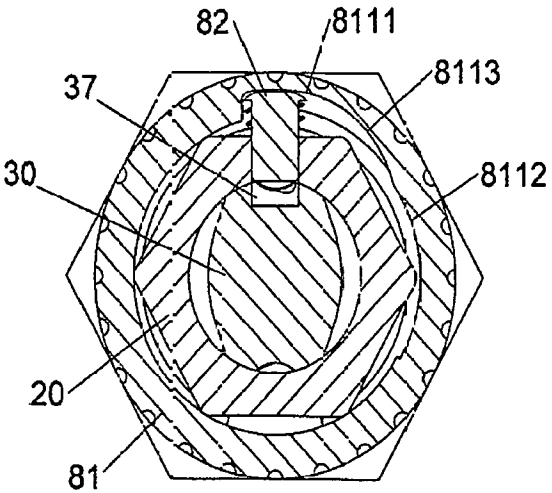
FIG. 15 is a cross sectional view, taken along line 15-15 in FIG. 14.

As shown in FIGS. 14 and 15, the insertion member 82 extends through the second hole 26 and is biased by the resilient member 83 so as to contact the first face 8111 of the control portion 811. The first end of the insertion member 82 is removed from the engaging slot 37.

Figure 16:
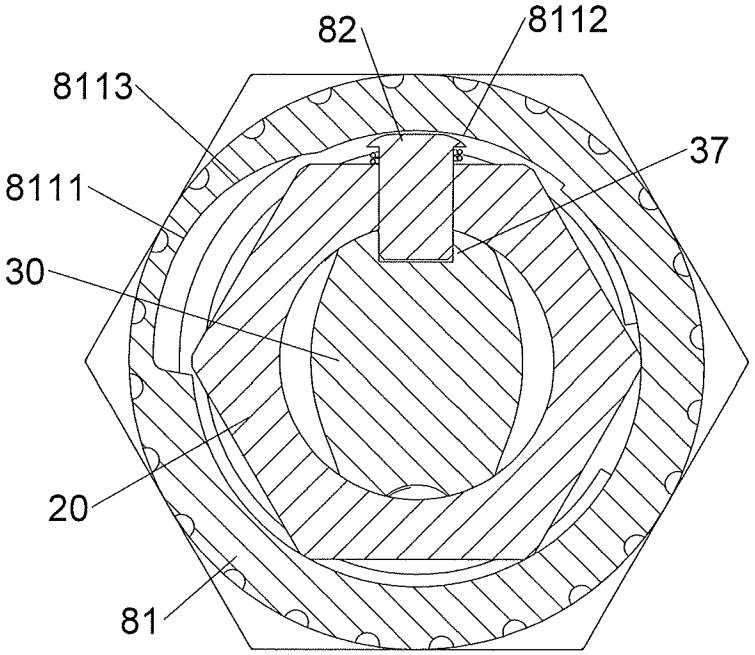
FIG. 16 shows that the insertion member is inserted into the engaging slot of the driving rod.

As shown in FIG. 16, when the user wants to secure the driving rod 30, the user rotates the control collar 81 to let the second face 8112 push the insertion member 82 and the resilient member 83 is compressed. The first end of the insertion member 82 is engaged with the engaging slot 37. The tubular member 20 is connected with the driving rod 30 which is secured.

Figure 17:
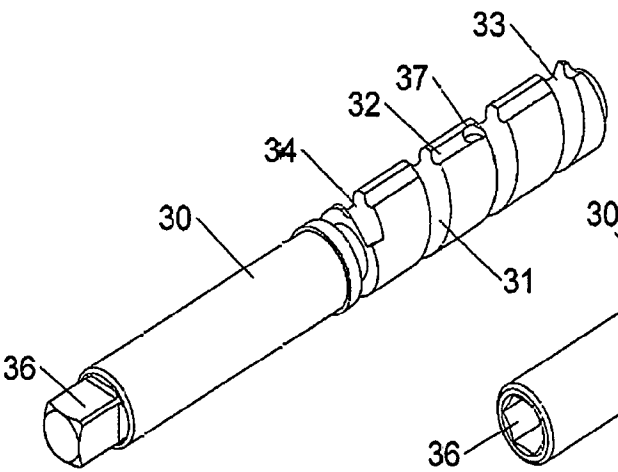
FIG. 17 shows another embodiment of the driving rod of the hand tool of the present invention.

As shown in FIG. 17, there is one spiral groove 31 defined in the outside of the driving rod 30 and toward the first end of the driving rod 30, and one straight slot 32.

Figure 18:
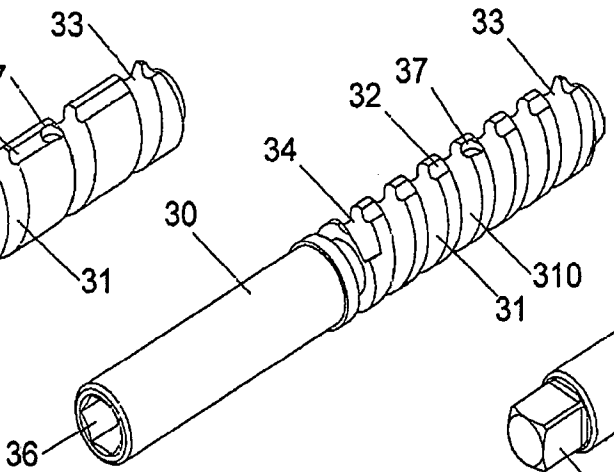
FIG. 18 shows yet another embodiment of the driving rod of the hand tool of the present invention.

As shown in FIG. 18, there are two spiral grooves 31, 310 defined in the outside of the driving rod 30 and toward the first end of the driving rod 30, and two straight slots 32. Only one straight slot 32 is shown, the other one is located at the underside of the driving rod 30. The function end 36 is a reception recess.

Figure 19:
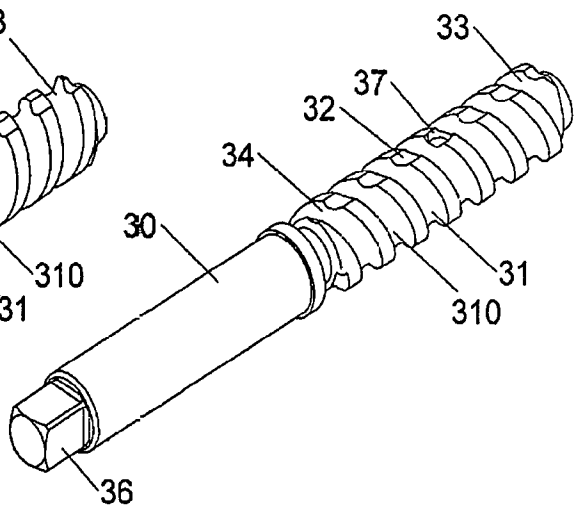
FIG. 19 shows a further embodiment of the driving rod of the hand tool of the present invention.

As shown in FIG. 19, there are two spiral grooves 31, 310 defined in the outside of the driving rod 30 and extending toward the second end of the driving rod 30, and two straight slots 32. Only one straight slot 32 is shown, the other one is located at the underside of the driving rod 30. The function end 36 is a reception recess.

Figure 20:
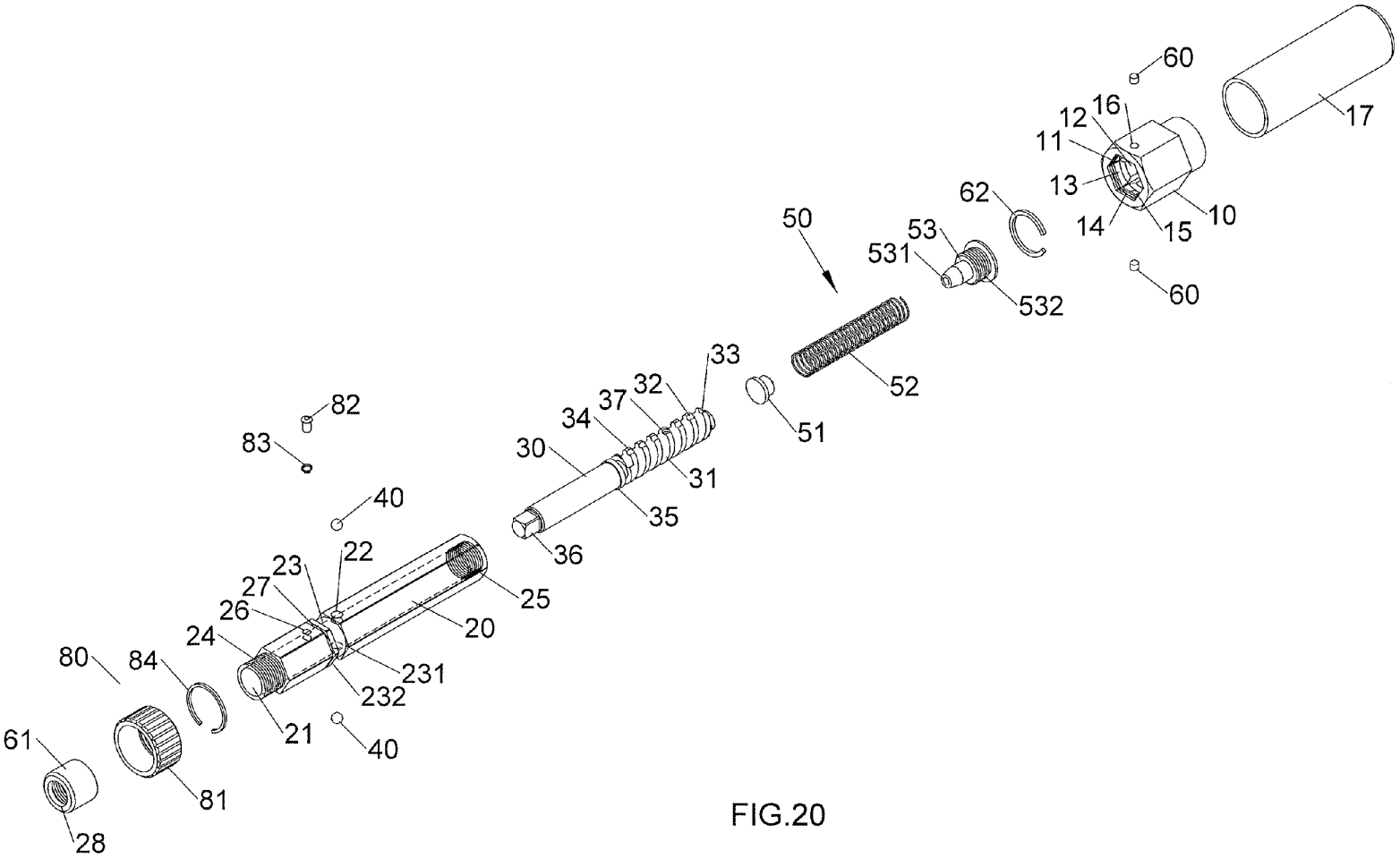
FIG. 20 is an exploded view of another embodiment of the hand tool of the present invention.

As shown in FIG. 20, the second end of the tubular member 20 has a threaded portion 24 and a cap 61 are threadedly connected to the threaded portion 24 on the tubular member 20. The cap 61 contacts the contact face 28 of the tubular member 20.

Figure 21:
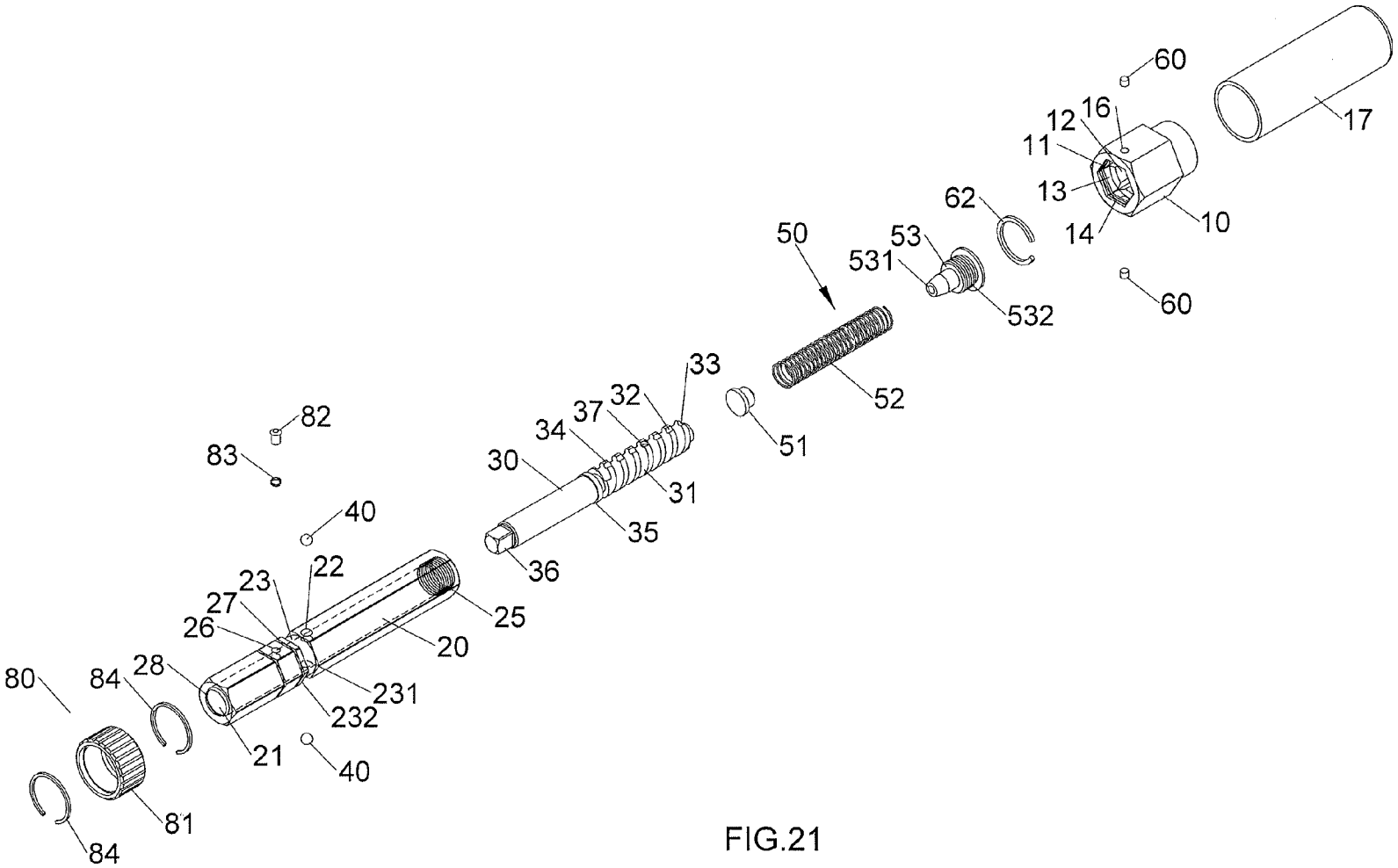
FIG. 21 is an exploded view of yet another embodiment of the hand tool of the present invention.
Figure 22:
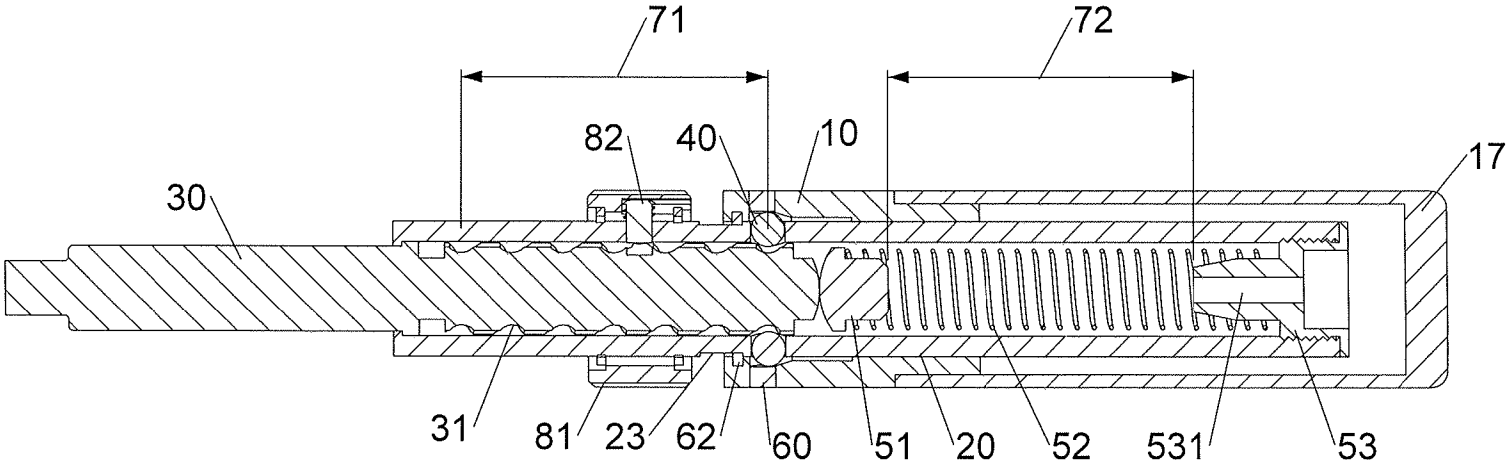
FIG. 22 is a cross sectional view of another embodiment of the hand tool of the present invention.

FIGS. 21, 22 show that there are two first snap grooves 27 located along a straight line, two second snap grooves 812 and two clips 84. The control collar 81 is mounted to the tubular member 20 by the two clips 84.

Figure 23:
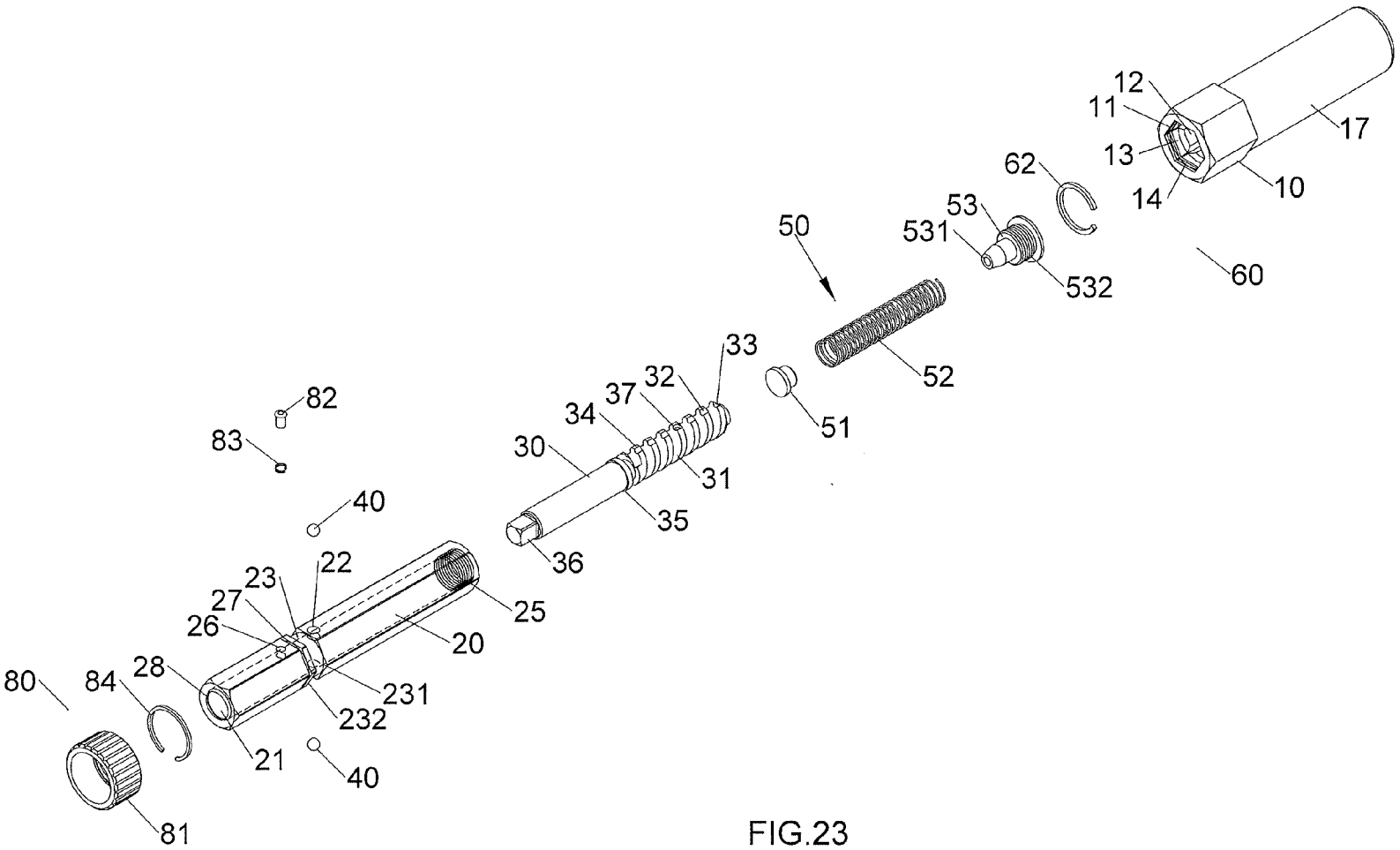
FIG. 23 is an exploded view of another embodiment of the hand tool of the present invention.

As shown in FIG. 23, the handle 10 does not have the first holes 16 and the magnetic members 60 as shown in FIG. 1, the holding portion 17 and the handle 10 are integral as a one-piece.

Figure 24:
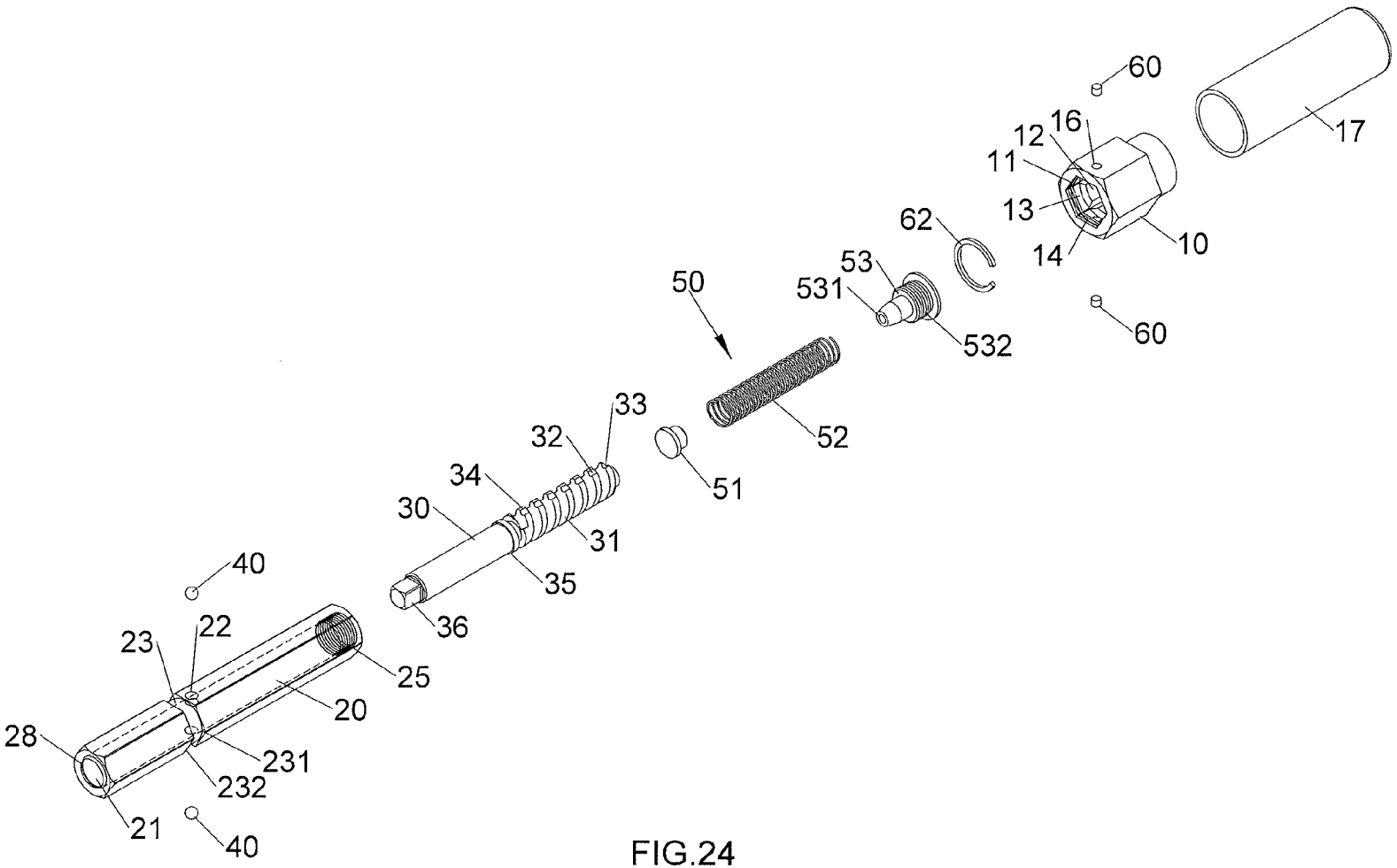
FIG. 24 is an exploded view of yet another embodiment of the hand tool of the present invention.

FIG. 24 shows that the tubular member 20 does not have the second holes 26 and the first snap groove 27 as shown in FIG. 1, and the driving rod 30 does not have the engaging slot 37 as shown in FIG. 1. There is no control unit 80 as shown in FIG. 1.

The advantages of the present invention are that the magnetic members 60 control the beads 40 to move between the straight slots 32 and the spiral grooves 31 to increase the operation efficiency.

The driving rod 30 linearly moves and rotates when retracting so as to rotate an object. When the driving rod 30 moves back to its initial position, the driving rod 30 does not rotate and the driving rod 30 does not need to be separated from the object.

The air in the through hole 21 can escape from the path 531 to allow the operation be smooth.

The control collar 81 is rotated to let the second face 8112 to push the insertion member 82 to be engaged with the engaging slot 37 so as to secure the tubular member 20 with the driving rod 30.

While we have shown and described the embodiment in accordance with the present invention, it should be clear to those skilled in the art that further embodiments may be made without departing from the scope of the present invention.

What is claimed is:

1. A hand tool comprising:

a handle having a polygonal passage defined therein, a pressing recess, a releasing recess and an annular engaging recess defined in a first end of the passage, the annular engaging recess located at a first end of the handle, the releasing recess located between the pressing recess and the annular engaging recess, an inner diameter of the pressing recess being larger than that of the passage, an inner diameter of the releasing recess being larger than that of the pressing recess, at least one first hole defined through a wall of the handle and a magnetic member engaged with the at least one first hole, the at least one first hole located corresponding to the releasing recess, a holding portion connected to a second end of the handle;

a tubular member linearly and un-rotatably movable in the path, a through hole defined axially through the tubular member, at least one bead hole defined through a wall of the tubular member and a bead being engaged with the at least one bead hole, the at least one bead hole located corresponding to the at least one first hole, an annular groove defined in an outside of the tubular member and located between a first wall and a second wall, an inner threaded section formed in an inner periphery of a first end of the tubular member, a contact face formed at a second end of the tubular member;

a driving rod linearly and rotatably movable in the through hole of the tubular member, at least one spiral groove and at least one straight slot defined in an outside of a first end of the driving rod, a depth of the at least one straight slot being smaller than that of the at least one spiral groove, the at least one spiral groove communicating with the at least one straight slot, a start point and an end point being respectively formed on a first ridge and a last ridge of the at least one spiral groove, a first distance defined between the start point and the end point, a flange extending outward from a mediate portion of the outside of the driving rod, the flange contacting the contact face, a function end formed on a second end of the driving rod;

a return unit located in the through hole of the tubular member and having a push member, a spring and an end member, the first end of the driving rod contacting the push member, the spring being biased between the push member and the end member, the end member having outer threads on an outside thereof, the outer threads of the end member being threadedly connected to the inner threaded section of the tubular member, a second distance defined between two respective facing ends of the push member and the end member, the first distance being equal to the second distance, and a C-clip movably located within the engaging recess and the annular groove, when the C-clip contacts the first wall, the handle is located at a release position relative to the tubular member, when the C-clip contacts the second wall, the handle is located at a press position relative to the tubular member.

2. The hand tool as claimed in claim 1, wherein the tubular member has a second hole defined through the wall thereof, the driving rod has an engaging slot defined in the at least one straight slot, the second hole is located corresponding to the engaging slot, a control unit has a control collar and an insertion member, the control collar is rotatably mounted to the tubular member and the insertion member is inserted into the second hole, a first end of the insertion member is located corresponding to the engaging slot, when the control collar is rotated, the first end of the insertion member is inserted into engaging slot to secure the tubular member with the driving rod which cannot rotate and move in the tubular member.

3. The hand tool as claimed in claim 2, wherein the control unit has a resilient member, the control collar has a control portion formed in an inner periphery thereof, the control portion has a first face, a second face and a connection face which is connected between the first and second faces, the first face has a curvature that is different from that of the second face, the insertion member located in the second hole, a second end of the insertion member contacts the control portion and the first end of the insertion member is located corresponding to the engaging slot, the resilient member is mounted to the insertion member and biased between the second end of the insertion member and the outside of the tubular member, when the control collar is rotated, the second end of the insertion member contacts the first face and the resilient member pushes the insertion member to remove the first end of the insertion member from the engaging slot, when the control collar is continuously rotated, the second end of the insertion member contacts the second face which pushes the insertion member, the resilient member is compressed and the first end of the insertion member is engaged with the engaging slot so that the tubular member is secured with the driving rod, the driving rod cannot move and rotate in the tubular member.

4. The hand tool as claimed in claim 3, wherein the tubular member has at least one first snap groove which is located close to the second hole, the at least one first snap groove is located between the annular groove and the second hole, the at least one first snap groove is an annular groove and located corresponding to the second hole, the control unit has a clip, the control collar has at least one second snap groove which is located corresponding to the at least one first snap groove, the clip of the control unit is located in the at least one first one snap groove and the at least one second snap groove.

5. The hand tool as claimed in claim 3, wherein a diameter of the first face is larger than that of the second face, the connection face is tangent to the first face, the control collar is a ring-shaped collar.

6. The hand tool as claimed in claim 3, wherein the control collar has multiple slots defined in an outside thereof.

7. The hand tool as claimed in claim 1, wherein the function end is a rectangular end.

8. The hand tool as claimed in claim 1, wherein the function end is a reception recess.

9. The hand tool as claimed in claim 1, wherein the push member has a flat face formed on an end thereof which contacts the first end of the driving rod, the end member has a path defined axially therethrough.

10. The hand tool as claimed in claim 1, wherein the push member has a curved face formed on an end thereof which contacts the first end of the driving rod.

11. The hand tool as claimed in claim 1, wherein there are multiple first holes, multiple bead holes, multiple spiral grooves and multiple straight slots, the spiral grooves extend toward the first end of the driving rod.

12. The hand tool as claimed in claim 1, wherein there are multiple first holes, multiple bead holes, multiple spiral grooves and multiple straight slots, the spiral grooves extend toward the second end of the driving rod.

13. The hand tool as claimed in claim 1, wherein the second end of the tubular member has a threaded portion and a cap is threadedly connected to the threaded portion on the tubular member, the cap contacts the contact face of the tubular member.

* * * * *